US006579070B1

(12) United States Patent
Birkenmaier et al.

(10) Patent No.: US 6,579,070 B1
(45) Date of Patent: Jun. 17, 2003

(54) PUMP ASSEMBLY COMPRISING TWO HYDRAULIC PUMPS

(75) Inventors: Egon Birkenmaier, Lohr/Main (DE); Günter Fischer, Gemünden (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/869,189

(22) PCT Filed: Dec. 16, 1999

(86) PCT No.: PCT/EP99/09995

§ 371 (c)(1),
(2), (4) Date: Jun. 21, 2001

(87) PCT Pub. No.: WO00/39465

PCT Pub. Date: Jul. 6, 2000

(30) Foreign Application Priority Data

Dec. 24, 1998 (DE) ..... 198 60 155
Oct. 29, 1999 (DE) ..... 199 52 167

(51) Int. Cl.[7] ..... F04B 49/00

(52) U.S. Cl. ..... 417/216; 417/286; 418/3; 418/259

(58) Field of Search ..... 417/216, 286, 417/310, 428, 429, 201, 204, 205, 206, 199.1; 418/3, 210, 275, 259, 268, 215

(56) References Cited

U.S. PATENT DOCUMENTS

| | | | | |
|---|---|---|---|---|
| 3,898,810 A | * | 8/1975 | Ohba et al. | 60/413 |
| 4,415,319 A | * | 11/1983 | Masuda et al. | 418/135 |
| 4,430,047 A | * | 2/1984 | Ilg | 417/273 |
| 4,586,468 A | * | 5/1986 | Dzioba | 123/198 |
| 4,621,982 A | * | 11/1986 | Schulz et al. | 417/201 |
| 5,842,837 A | * | 12/1998 | Nakayoshi et al. | 417/286 |

FOREIGN PATENT DOCUMENTS

| | | | |
|---|---|---|---|
| DE | 2114202 | | 10/1971 |
| DE | 1728276 | | 3/1972 |
| DE | 2630736 | | 3/1977 |
| DE | 3134150 | | 9/1982 |
| DE | 3132285 | | 3/1983 |
| DE | 3904874 | | 8/1989 |
| DE | 3928029 | | 3/1990 |
| DE | 19634822 | | 3/1997 |
| EP | 0128969 | | 12/1984 |
| EP | 0500022 | | 8/1992 |
| JP | 63-80085 | * | 4/1988 |
| JP | 8-284771 | * | 10/1996 |

* cited by examiner

*Primary Examiner*—Charles G. Freay
*Assistant Examiner*—Han L. Liu
(74) *Attorney, Agent, or Firm*—Martin A. Farber

(57) ABSTRACT

A pump assembly which comprises a vane pump and a second hydraulic pump driven together with this vane pump. The vane pump has a suction region in which first pressure spaces between the vanes and second, rear pressure spaces behind the vanes become larger and a pressure region in which the pressure spaces become smaller and in which the pressure spaces are fluidically connected to a pressure outlet. This vane pump is intended particularly for supplying operating cylinders of a hydromechanical transmission of a motor vehicle with pressure fluid under relatively high pressure. The second hydraulic pump has positively driven displacement elements and is intended for supplying a circuit having a relatively low system pressure, in particular a lubricating-oil circuit of the motor vehicle, with pressure fluid. So that the vane pump also begins to deliver at low outside temperatures and with highly viscous pressure fluid even at low rotational drive speeds, the rear pressure spaces of the vane pump are connected in the suction region to the pressure outlet of the second hydraulic pump.

20 Claims, 8 Drawing Sheets

PUMP ASSEMBLY COMPRISING TWO HYDRAULIC PUMPS

FIELD AND BACKGROUND OF THE INVENTION

The invention is based on a pump assembly which comprises a vane pump, which, in particular, is to serve to supply operating cylinders of a hydromechanical transmission of a motor vehicle with a pressure fluid under high pressure, and a second hydraulic pump, the displacement elements of which are positively driven and which serves to supply a circuit having a low system pressure, in particular a lubricating-oil circuit of the motor vehicle, with the pressure fluid. The two hydraulic pumps therefore work with the same operating medium.

A pump assembly which comprises a vane pump and a second hydraulic pump whose displacement elements are positively driven has already been disclosed by EP 0 128 969 A1. In this publication, the oil flow of the vane pump serves to supply pressure medium to a power-assisted steering system. The second hydraulic pump is a radial piston pump, the oil flow of which serves a device for regulating the level of the vehicle. The two hydraulic pumps of the known pump assembly are located in two pressure-fluid circuits which only have the oil supply tank in common.

A vane pump generally has a suction region in which first pressure spaces between the vanes and second, rear pressure spaces behind the vanes become larger and receive pressure fluid in the process. In a pressure region, the pressure spaces become smaller, as a result of which pressure fluid is displaced to a pressure outlet. For satisfactory functioning of the vane pump, it is necessary for the vanes, which are guided in radial slots of a rotor, to bear against a stroke ring. Centrifugal forces which act on the vanes are utilized for such a unit, the effect of which centrifugal forces requires a substantial pressure balance between the front side bearing against the stroke ring and the rear side of the vanes in the slots. This condition is met due to the fact that the rear pressure spaces are also connected in the pressure region to the pressure outlet of the pump. In the suction region, both the first pressure spaces and the second pressure spaces are normally connected to the suction inlet of the vane pump, so that the same pressures again prevail in them.

The higher the viscosity of the pressure fluid, this viscosity increasing with decreasing temperature, the higher are the centrifugal forces which are required for bringing the vanes to bear against the stroke ring. This means that a vane pump of a conventional type of construction only begins to deliver at a rotational speed which is all the higher, the lower the temperature of the pressure fluid is. In particular, the engine and transmission oil of a motor vehicle, in particular of a farm tractor, may become so viscous at low ambient temperatures that the vane pump only begins to deliver at unacceptable high rotational speeds.

The object of the invention is to develop a pump assembly according to the preamble of patent claim 1 in such a way that satisfactory operation is possible even at low ambient temperatures and thus at a high viscosity of the pressure fluid.

SUMMARY OF THE INVENTION

According to the invention, this object is achieved in a pump assembly of the introductory mentioned-type in that the rear pressure spaces of the vane pump are connected in the suction region to the pressure outlet of the second hydraulic pump. Since the displacement elements of the second hydraulic pump are positively driven, the second hydraulic pump starts to deliver when it is driven, irrespective of the viscosity of the pressure fluid. The pressure building up at its pressure outlet is then also present in the rear pressure spaces of the vane pump and produces at the vanes a force which, in addition to the centrifugal force, presses the vanes radially outward against the stroke ring. The system pressure in the circuit which is supplied by the second hydraulic pump is relatively low and may be within the region of, for example, 5 bar. The frictional force between the vanes and the stroke ring therefore increases only slightly in the suction region of the vane pump, so that the wear on these parts continues to remain low.

DE-B 17 28 276 has certainly already disclosed a pump assembly which comprises two hydraulic pumps and in which the rear pressure spaces at the vanes of a first hydraulic pump formed as a vane pump are connected in their suction region to the pressure outlet of the second hydraulic pump. Here too, however, the second hydraulic pump is a vane pump which fails with highly viscous pressure fluid, so that the problem underlying the invention is not removed in the pump assembly disclosed by DE-B 17 28 276.

Thus, the vane pump is preferably one with a variable displacement volume, since the consumption of non-utilizable energy can thereby be reduced compared with a vane pump having a constant displacement volume. Since, in particular when used in motor vehicles, in addition to being economical with primary energy, it is very important that the individual components are inexpensive, the vane pump according to patent claim 3 is advantageously directly controlled and, upon reaching a set maximum pressure with its displacement volume, returns to such an extent that, at the maximum pressure, only the small quantity lost due to internal leakage is replaced. The power loss which then results from the product of the maximum pressure and the leakage quantity is slight, since the leakage quantity is slight.

The second hydraulic pump is advantageously a gear pump, in particular an internal gear pump without a filling piece, which gear pump works quietly, is favorable in production and can also be configured in its construction in such a way that it can be combined with the vane pump to form a construction unit without great outlay, as specified in patent claim 6.

BRIEF DESCRIPTION OF THE DRAWINGS

Three exemplary embodiments of a pump assembly according to the invention are shown in the drawings. The invention will now be explained in more detail with reference to the figures of these drawings.

In the drawings.

DETAILED DESCRIPTION OF THE PREFERRED EMBODIMENT

Figure 1:
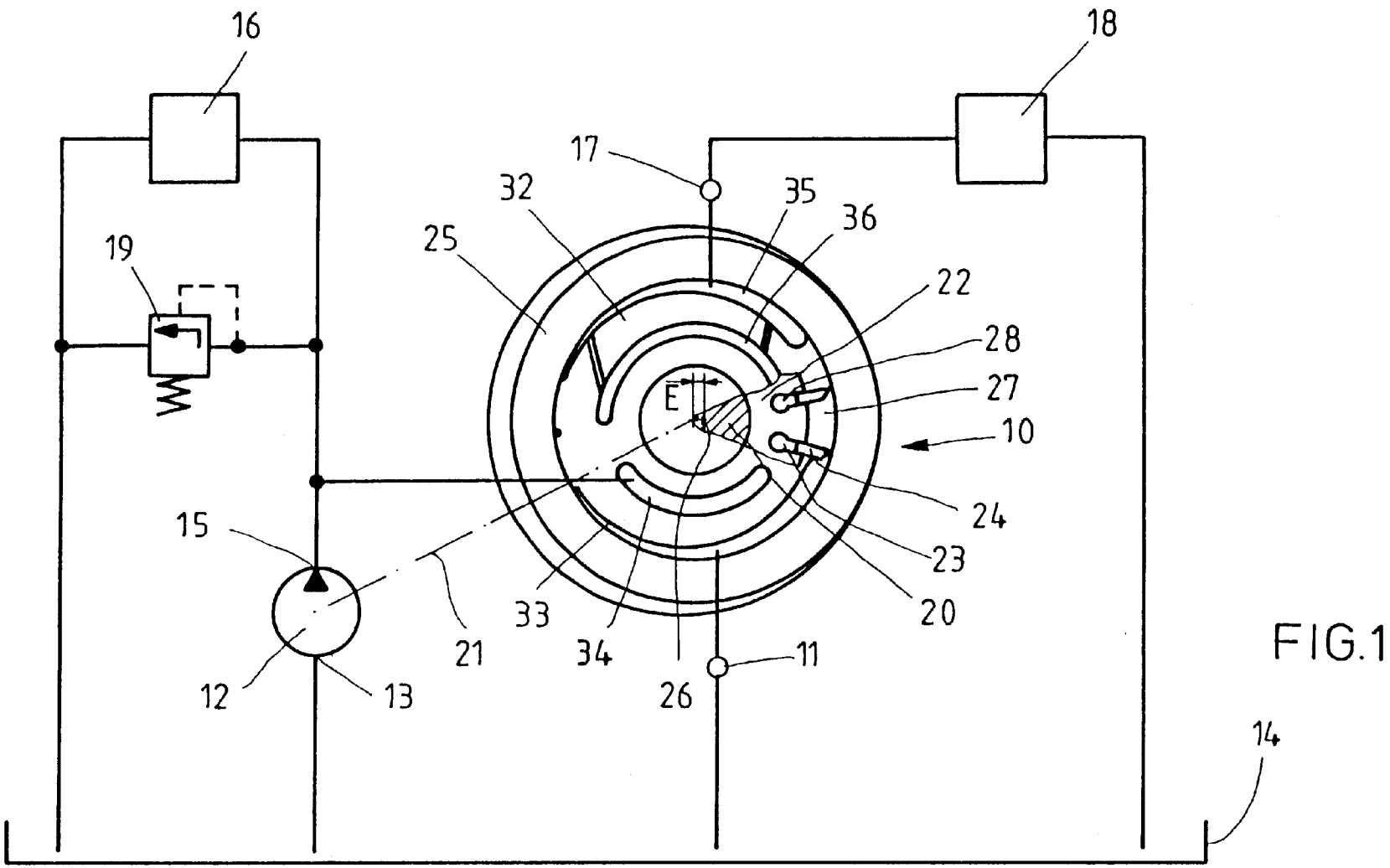
FIG. 1 shows the first exemplary embodiment more in the form of a circuit diagram.
Figure 2:
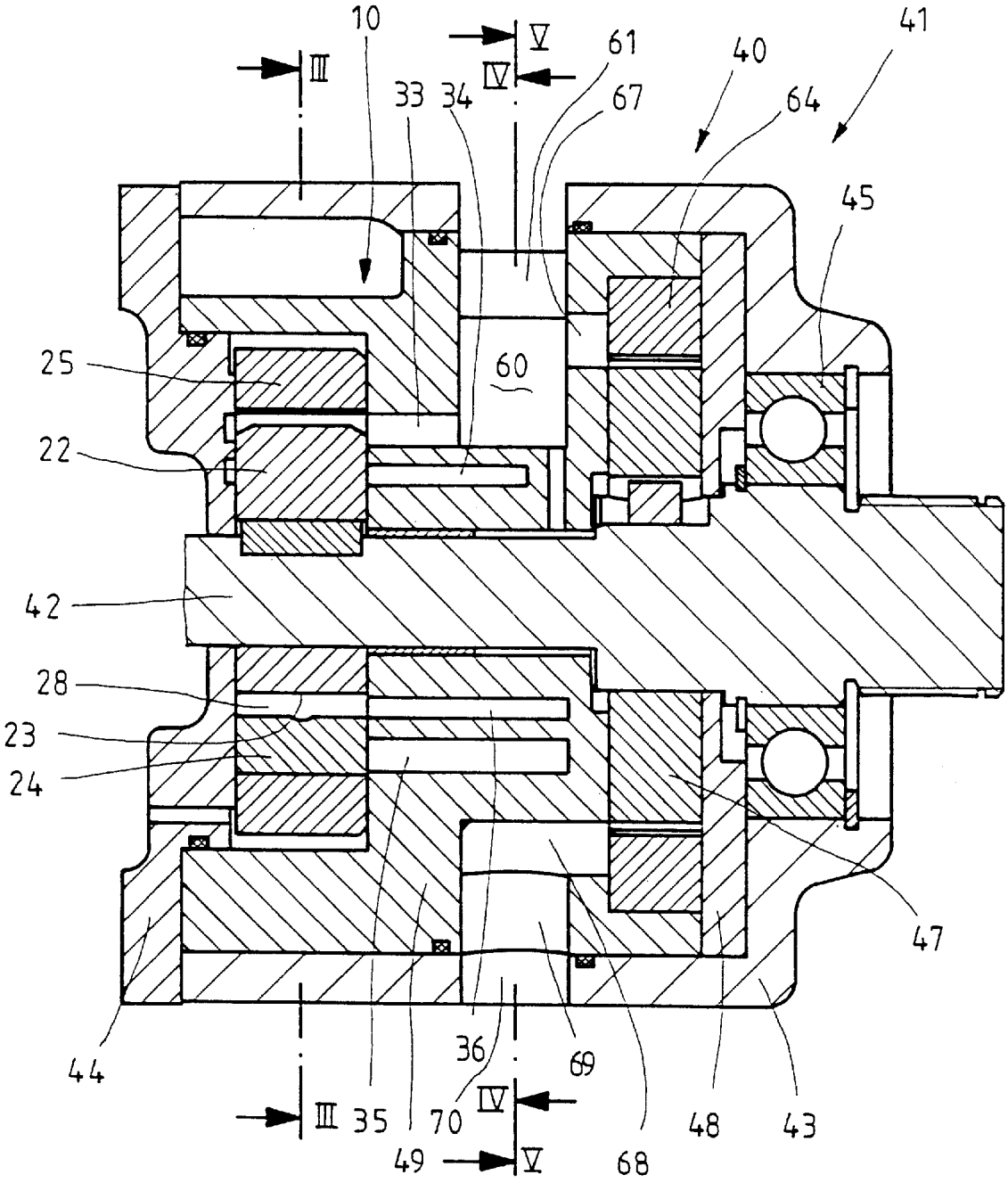
FIG. 2 shows a longitudinal section including the axis of the drive shaft through the second exemplary embodiment, in which the vane pump and the second hydraulic pump formed as an internal gear pump are combined to form a construction unit with a common control part fixed to the housing.
Figure 3:
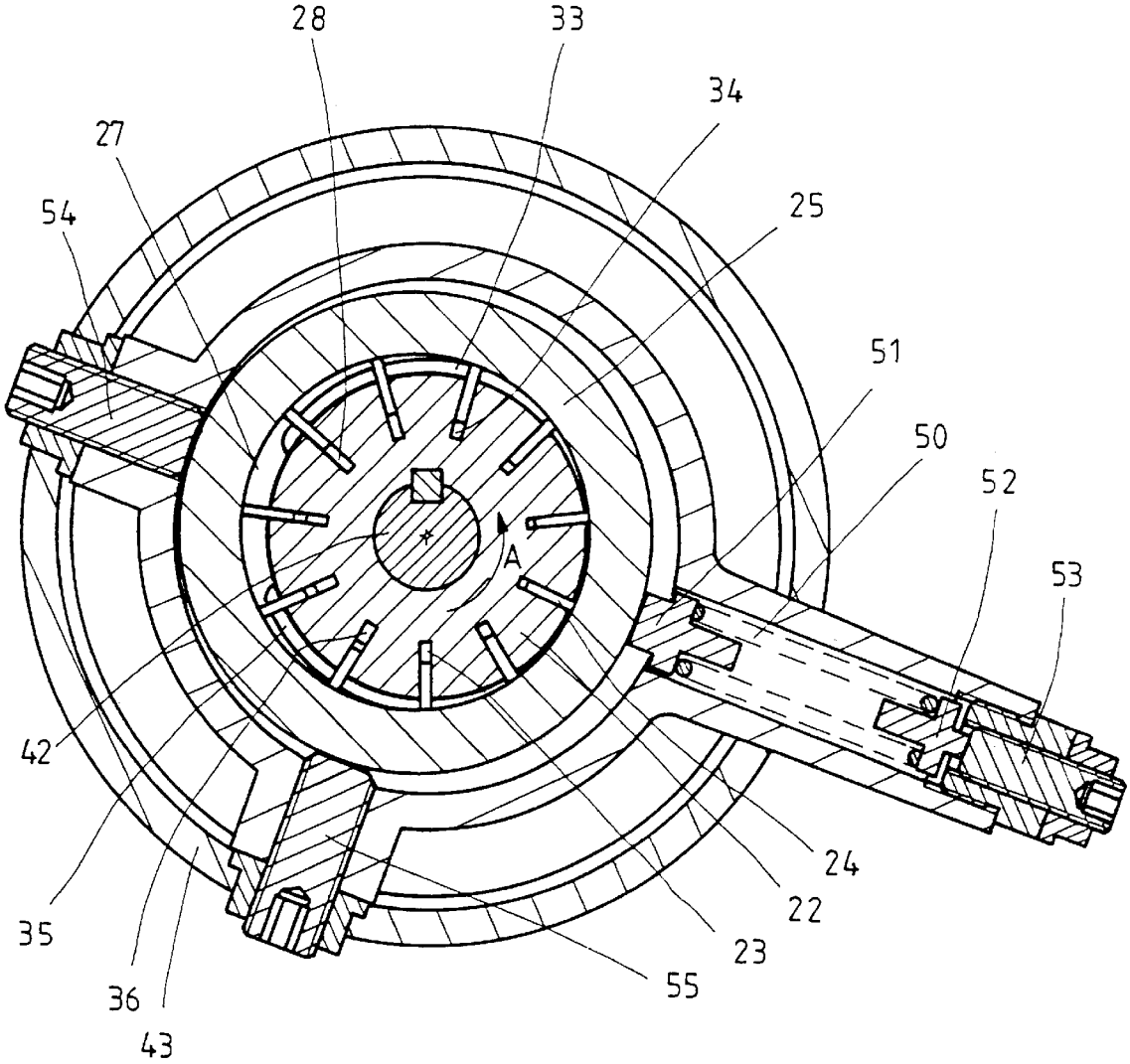
FIG. 3 shows a section along line III—III from FIG. 2.
Figure 4:
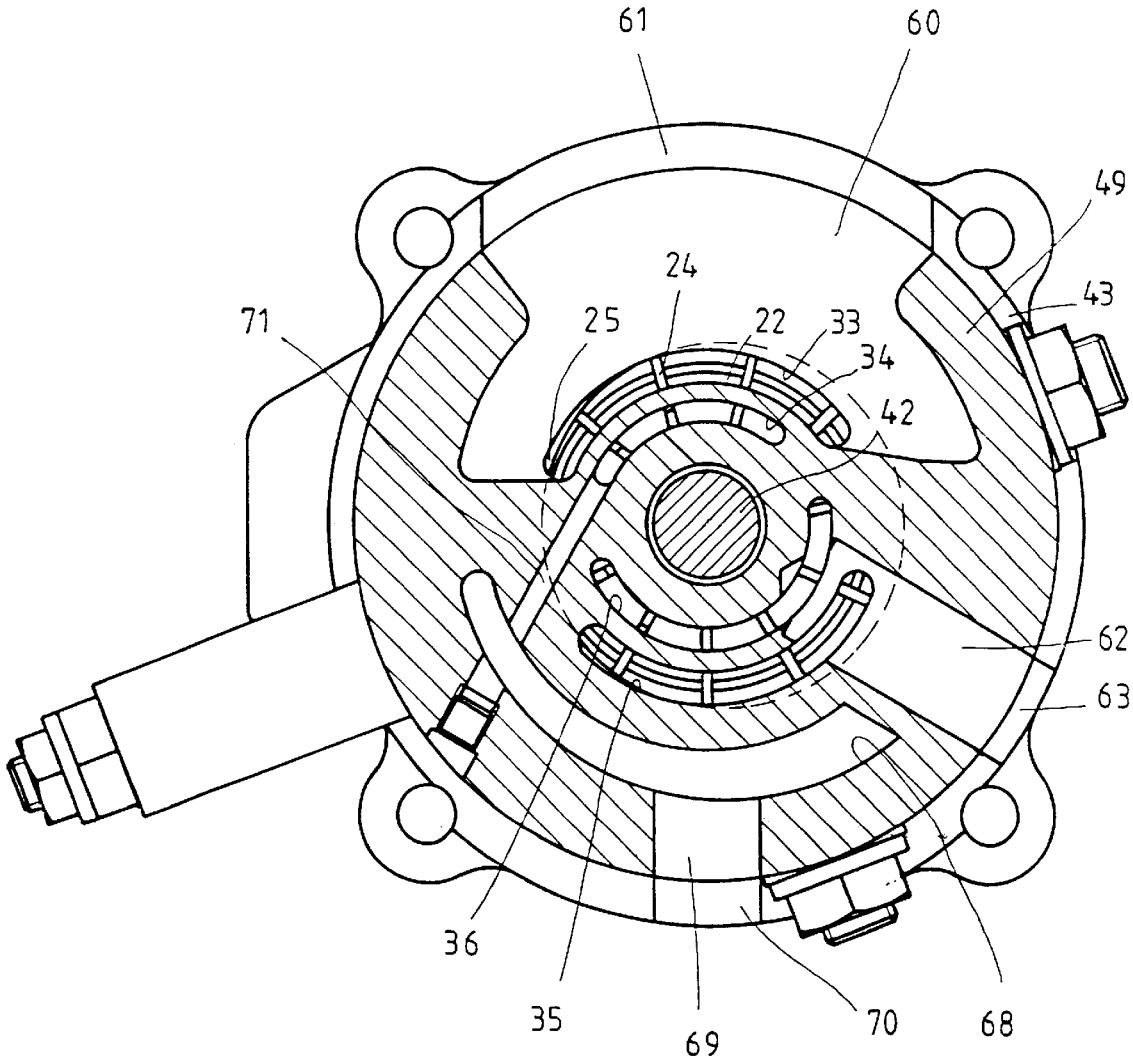
FIG. 4 shows a section along line IV—IV from FIG. 2.
Figure 5:
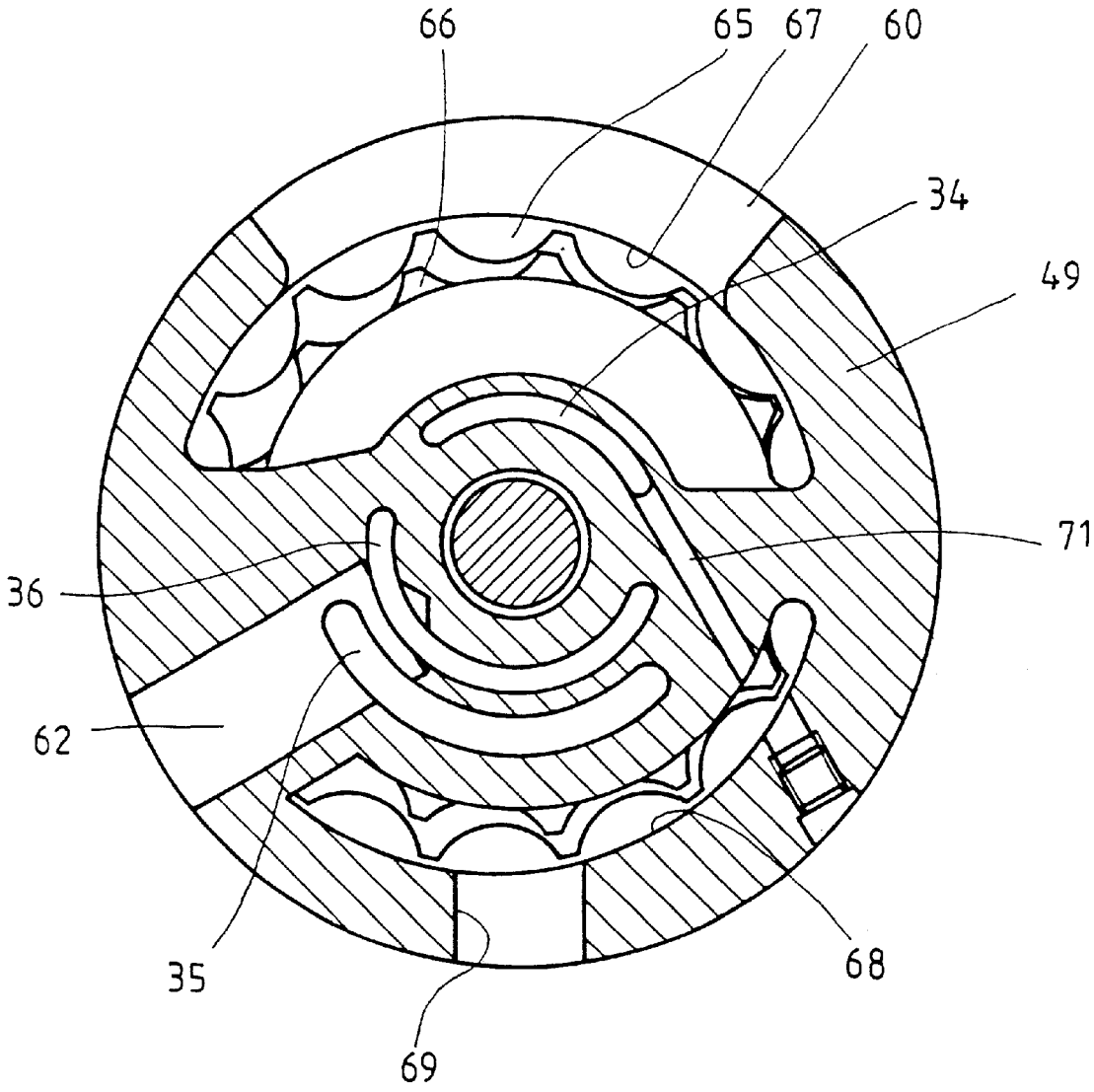
FIG. 5 shows a section along line V—V from FIG. 2.
Figure 6:
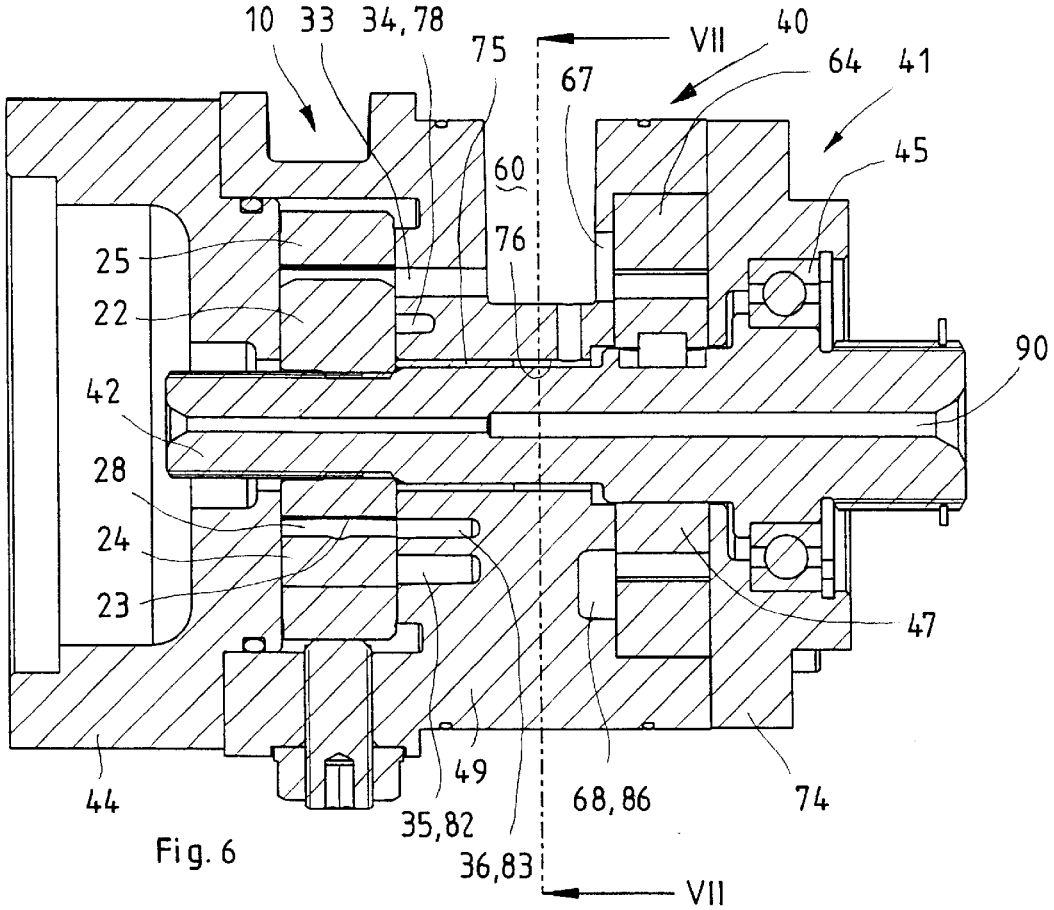
FIG. 6 shows a longitudinal section including the axis of the drive shaft through the third exemplary embodiment, which differs from the second exemplary embodiment essentially in the formation of the control grooves and in the arrangement of the pressure connections in the control part.

According to FIG. 1, a vane pump 10, via a suction inlet 11, and a second hydraulic pump 12, which is formed, for example, as a radial piston pump, the radial pistons of which bear against an eccentric under spring pressure, via a suction inlet 13, draw in pressure fluid from a tank 14 which is formed by the housing of the transmission of a motor vehicle, e.g. a farm tractor. Since the radial pistons of the radial piston pump 12 are pressed against the eccentric by springs, the radial pistons may be designated as positively driven displacement elements. Via a pressure outlet 15, the radial piston pump delivers pressure fluid into a lubricating-oil circuit 16 of the motor vehicle transmission, the pressure in the pressure outlet 15 being 4 bar to 5 bar if the pressure fluid has reached operating temperature. The transmission oil flows from the lubricating-oil circuit 16 back into the tank 14. A pressure-limiting valve 19 protects the pressure outlet 15 of the hydraulic pump 12.

Various hydraulic loads 18 are supplied with pressure fluid from the vane pump 10 via a pressure outlet 17, these loads 18 being, for example, operating cylinders of a hydrostat, belonging to the transmission of the motor vehicle, and hydraulic actuators of couplings.

The vane pump 10 and the second hydraulic pump 12 are driven via a drive shaft 20 which is common to them and has an axis 21 and to which a rotor 22 is fastened in a rotationally locked manner. Uniformly distributed over the circumference of the rotor are radial slots 23 in which vanes 24 are guided. The latter project radially beyond the circumference of the rotor 22 and bear against a stroke ring 25 having a circular-cylindrical stroke curve, the axis of which is at a distance E from the axis 21 of the drive shaft 20, this axis E being variable between zero and a maximum value. The vane pump 10 is therefore a vane pump having a variable displacement volume. The vanes 24 form first pressure spaces 27 between them and, at their rear side facing the base of the slots 23, second, rear pressure spaces 28 in the slots 23.

Bearing laterally against the stroke ring 25 and against the rotor 22 is a control disk 32 which has a total of four control grooves open toward the rotor 22. A radially outer suction groove 33 is fluidically connected to the suction inlet 11 and is made in the control disk 32 in such a way that the first pressure spaces 27 are congruent with it while they become larger. In this case, it should be noted that the rotor is driven counterclockwise in the view according to FIG. 1. Located radially further inward than the suction groove 33 is a further suction groove 34 with which the second pressure spaces 28 are congruent while they become larger. It is now essential that the suction groove 34 is not connected to the suction inlet 11 of the vane pump 10 but to the pressure outlet 15 of the radial piston pump 12. The pressure spaces 28, in the suction region of the vane pump 10, in which suction region their volume increases, are therefore acted upon by the pressure prevailing at the pressure outlet 15 of the radial piston pump 12 and are pressed outward against the stroke ring 26. In the pressure region of the vane pump 10, in which the pressure spaces 27 and 28 become smaller, these pressure spaces are congruent with a radially outer pressure groove 35 and with a radially inner pressure groove 36. These two pressure grooves are fluidically connected to one another and to the pressure outlet 17, so that the vanes 24, in the pressure region, are acted upon by the same pressure at their front side and at their rear side.

During prolonged stoppage of the vehicle in which the hydraulic pumps 10 and 12 and also the lubricating-oil circuit 16 and the hydraulic loads 18 are located, and at low ambient temperatures, the pressure fluid with which work is carried out is highly viscous. Since the displacement elements of the hydraulic pump 12 are positively driven, this pump immediately starts to deliver the highly viscous pressure fluid when the drive shaft 20 starts to rotate. Pressure builds up in the pressure outlet 15 and presses the vanes 24 of the vane pump 10 radially outward in the suction region, so that the vane pump likewise delivers the pressure fluid even at low rotational speeds of the drive shaft 20. It may also be pointed out here that the pressure at the pressure outlet 15 of the hydraulic pump 12 is all the higher, the higher the viscosity of the pressure fluid is. This is because the hydraulic resistance of the lubricating-oil circuit causes a load pressure which is all the higher, the higher the viscosity of the pressure fluid is, on the other hand, the auxiliary force which ensures that the vanes 24 of the vane pump 10 bear reliably against the stroke ring 25, this auxiliary force being required in addition to the centrifugal force, is all the greater, the higher the viscosity is. An auxiliary force on the vanes 24 of the vane pump 10 is therefore obtained without further measures, this auxiliary force depending in the correct sense on the viscosity of the pressure fluid.

In the embodiment according to FIGS. 2 to 5, a vane pump 10 and a second hydraulic pump formed as an internal gear pump 40 without a filling piece are combined to form a construction unit, these pumps being located in a multipiece common housing 41 and being driven via a single drive shaft 42. The housing is composed of a pot-shaped housing part 43 and a lid-shaped housing part 44. A ball bearing 45 in which the drive shaft 42 is mounted is located in the base of the housing part 43. The drive shaft 42 projects with one end beyond the base of the housing part 43 and is provided with serrations at this end. A gear (not shown in any more detail) for the drive of the double pump can be pushed onto this end. The rotor 22 of the vane pump 10 and an externally toothed gear 47 of the internal gear pump 40 are fastened to the drive shaft 42 in a rotationally locked manner at an axial distance from one another. The gear 47 is located in a circular-cylindrical pump space which is formed between a side disk 48, resting on the base of the housing part 43, and a control part 49, arranged fixedly in the housing as the side disk 48 which essentially occupies the space between rotor 22 and gear 47 and reaches with an annular-cylindrical collar up to the side disk 48. The rotor 22 of the vane pump 10 is located in a further circular-cylindrical pump space which is formed between the lid 44 and the control part 49 and reaches with a circular-cylindrical extension up to the lid 44 and overlaps a centering collar on the latter. Also located in the pump space of the vane pump 10 is the stroke ring 25, which during normal operation is pressed by a compression spring 50 against an adjusting screw 54, diametrically opposite the compression spring 50, for the maximum stroke volume, the compression spring 50 being supported via a first spring plate 51 on the stroke ring 25 and via a second spring plate 52 on a setting screw 53 for the maximum operating pressure. During operation, the rotor rotates counterclockwise in the direction of arrow A in FIG. 3, the pressure region, as viewed continuously in the direction of rotation, lying between the adjusting screw 54 and the compression spring 50. The force component produced by the pressure and acting perpendicularly to the connecting line between the adjusting screw 54 and the compression spring 50 is absorbed by the height adjusting screw 55, which determines the position of the stroke ring perpendicularly to the connecting line between the adjusting screw 54 and the compression spring 50. On the inside, the vanes 24 guided radially in the slots 23 of the rotor 22 bear against the stroke ring. The pressure spaces 27 between the vanes and the pressure spaces 28 on the rear side of the vanes can be seen in FIG. 3.

A radially open spacious recess 60 in the control part 49, above which recess 60 the housing part 43 also has an opening 61, forms the suction inlet for both the vane pump 10 and the internal gear pump 40. The outer suction groove 33 of the vane pump 10 extends axially between the recess 60 and that end face of the control part 49 which faces the rotor 22. To be precise, the suction groove 33 is located approximately at the outer circumference of the rotor 22. Further inward, namely in the region of the base of the slots 23, the inner suction groove 34 opens into the pump space of the vane pump 10 and, as viewed in the axial direction, extends beyond the center of the recess 60 into the control part 49. The recess 60 does not extend radially up to the suction groove 34. There is no fluidic connection between the suction groove 34 and the recess 60, that is the suction inlet of the two pumps. Approximately opposite the suction grooves 33 and 34, the inner pressure groove 36, beyond which the rear pressure spaces 28 extend, and the outer pressure groove 35, toward which the pressure spaces 27 open, are incorporated in the control part 49. The two pressure grooves also extend deep into the control part 49. Located in the control part 49 in the same radial plane in which the recess 60 also lies is a radial bore 62 which is extended outward through a corresponding bore 63 in the housing part 43 and intersects the two pressure grooves 35 and 36 close to its one end. The bores 62 and 63 form the pressure outlet of the vane pump 10, with which pressure outlet the two pressure grooves 35 and 36 are thus fluidically connected.

The externally toothed gear 47 of the internal gear pump 40 is surrounded on the outside by an internally toothed ring gear 64, which is mounted at its outer circumferential surface in the control part 49 in such a way as to be rotatable eccentrically relative to the gear 47. It has one tooth 65 more than the gear 47. The teeth 66 of the latter and the teeth 65 of the gear 64 slide along one another and form pressure spaces between them as the positively driven displacement elements of the gear pump 40, these pressure spaces, during operation, becoming larger in the suction region and smaller in the pressure region. In the suction region, the pressure spaces are open toward a suction groove 67 which passes through a wall of the control part 49 located between the pump chamber of the internal gear pump 40 and the recess 60. Located approximately opposite the suction groove 67, a pressure groove 68 of the internal gear pump 40 is incorporated in the control part radially outside the pressure grooves 35 and 36 of the vane pump 10. The pressure groove 68 extends axially beyond the radial plane in which the radial bore 62 and the recess 60 of the control part 49 lie into the control part 49. A radial bore 69 in the control part 49, which radial bore 69 lies in said radial plane and is open on the inside toward the pressure groove 68, and a radial bore in the housing part 43, which radial bore is in alignment with the radial bore 69, form the pressure outlet of the internal gear pump 40. As can be seen in particular from FIGS. 4 and 5, the pressure groove 68, in the peripheral direction, ends at a distance from the radial bore 62 of the control part 49, so that there is no fluidic connection between the pressure outlets of the two pumps.

Starting from this pressure groove 68 in the vicinity of its other end is a bore 71 which is incorporated in the control part 49 tangentially from outside, leads past the pressure grooves 35 and 36 of the vane pump and opens tangentially into one end of the suction groove 34 of the vane pump 10. As a result, this suction groove 34 of the vane pump 10 is fluidically connected to the pressure groove 68 of the internal gear pump 40. The rear pressure spaces 28 of the vane pump 10 are therefore filled with fluid in the suction region from the pressure outlet of the internal gear pump 40, so that at least approximately the same pressure prevails in them as in the pressure outlet of the internal gear pump 40. The way in which the bore 71 opens into the suction groove 34 helps to ensure that any pressure loss between the pressure groove 68 and the suction groove 34 is only slight. The bore 71 lies in a radial plane which passes centrally through the recess 60 and the bores 62 and 69 of the control part 49. It meets the suction groove 34, since the latter extends axially beyond this radial plane into the control part 49. However, it is also conceivable to make the suction groove 34 less deep and to arrange the bore 71 in a radial plane lying closer to the pump chamber of the vane pump or to also cause it to run at an angle relative to a radial plane in such a way that its starting point at the pressure groove 68 is at a greater distance from the pump chamber of the vane pump 10 than its point which opens into the suction groove 34. As can be seen from FIGS. 4 and 5 with reference to the position of the various suction and pressure grooves, the suction and pressure regions of the vane pump 10 are rotated slightly relative to the suction and pressure regions of the internal gear pump 40. As a result, on the one hand, the suction groove 34 has come into a somewhat more favorable position in order to provide the connecting passage between it and the pressure groove 68. On the other hand, the pressure grooves 35 and 36 of the vane pump 10 have shifted away slightly from one end of the pressure groove 68, so that there is sufficient material on the control part 49 between them and the recess 60 in order to lay the connecting passage 71 in the material between suction groove 34 and pressure groove 68.

In the embodiment according to FIGS. 6 to 10, an adjustable vane pump 10 and a second hydraulic pump formed as an internal gear pump 40 without a filling piece are also combined to form a construction unit. Both pumps are driven via a single drive shaft 42. In a slightly different manner from the second embodiment, the housing 41 is composed of the center control part 49, which, in one end face, has the pump space for the rotor 22 having the vanes 24 located in the slots 23 and for the stroke ring 25 of the vane pump 10 and, in the opposite end face, has the pump space for the externally toothed gear 47 and the internally toothed gear 64 of the internal gear pump 40, and of the lid 44, to which the, pump space of the vane pump is connected, and of a further lid 74, to which the pump space of the internal gear pump is connected. The further lid 74 performs the two functions which are performed in the second exemplary embodiment by the side disk 48 and the base of the housing pot 43. Accordingly, a ball bearing 45 in which the drive shaft 42 is mounted is inserted into it. In addition to being mounted in the ball bearing 45, the drive shaft 42, as in the second exemplary embodiment, is also mounted in a plain bearing 75, which is inserted into a central bore 76 of the control part 49 and extends by a certain distance into the control part from the vane-pump-side end of the bore 76. The two lids 44 and 74 and the control part 49 are held together by long machine screws in a manner not shown in any more detail.

The adjusting mechanism of the vane pump 10 of the third exemplary embodiment is the same as in the second exemplary embodiment, so that it need not be dealt with in more detail. The gear set 47, 64 which is used for the internal gear pump 40 in the third exemplary embodiment is smaller in diameter than the gear set of the second exemplary embodiment.

Figure 7:
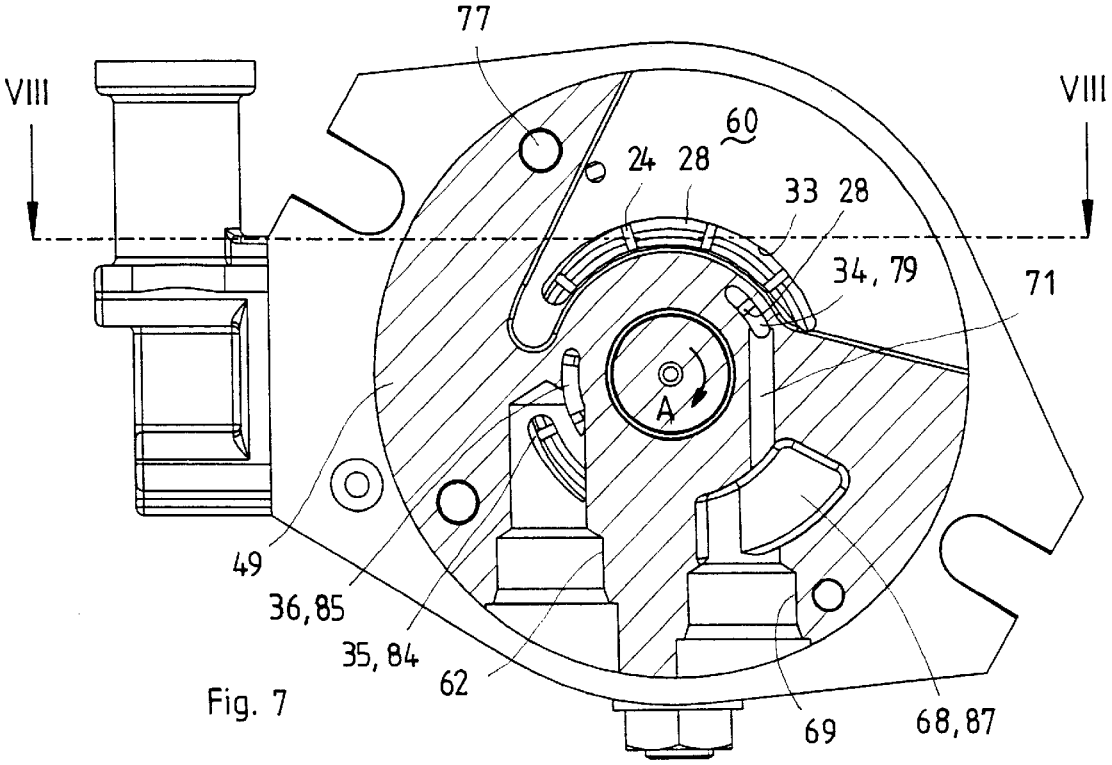
FIG. 7 shows a section along line VII—VII from FIG. 6.
Figure 8:
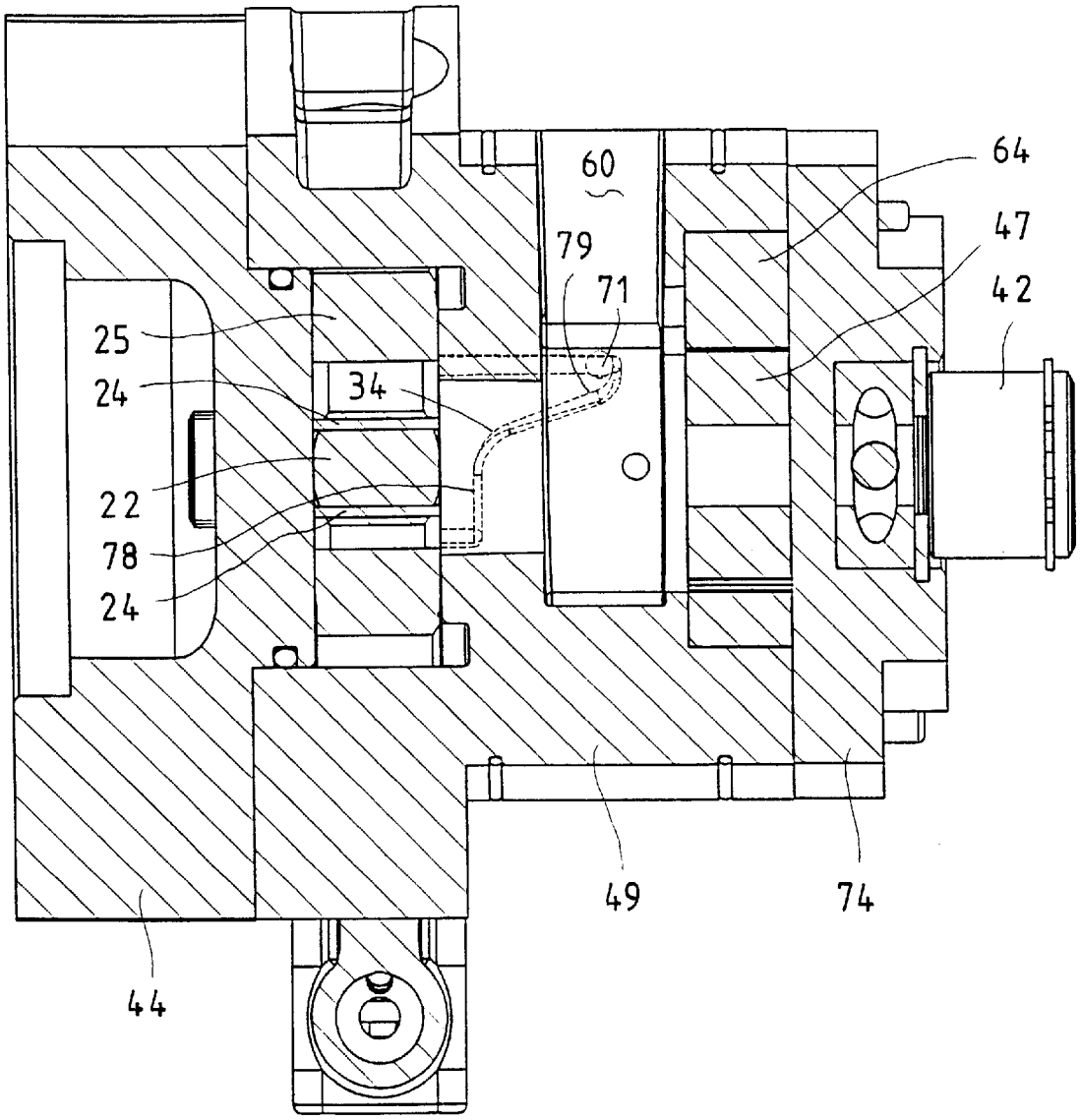
FIG. 8 shows a longitudinal section through the third exemplary embodiment along line VIII—VIII in FIG. 7.
Figure 9:
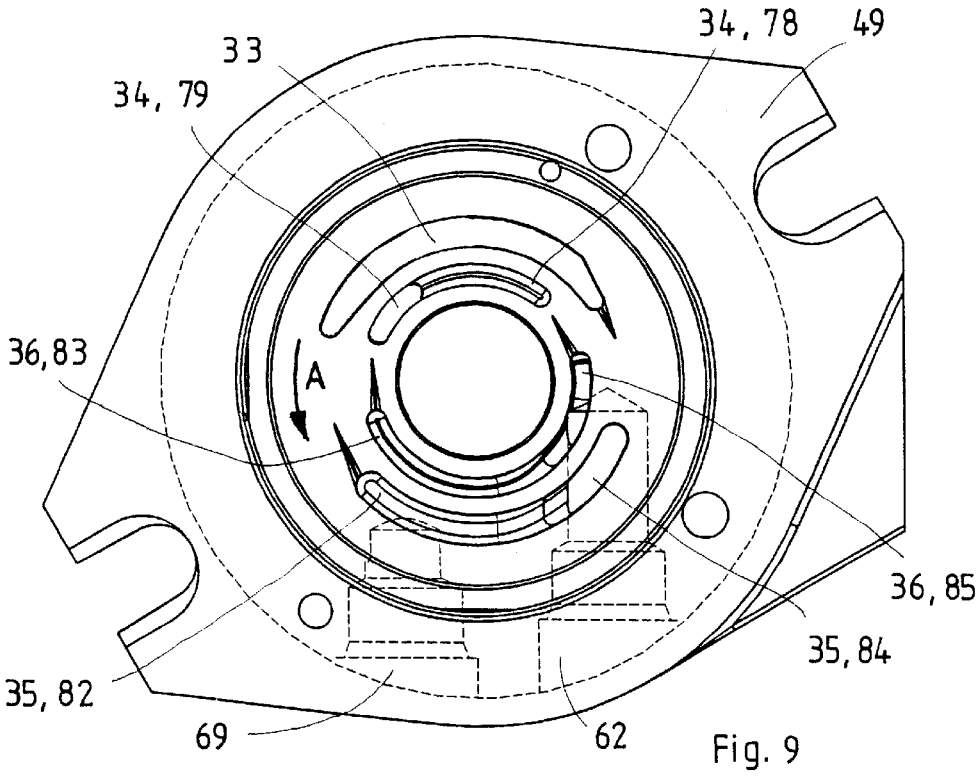
FIG. 9 shows a view of the vane-pump-side end face of the control part.

During operation, the drive shaft 42 rotates clockwise as viewed in FIG. 7 and counterclockwise as viewed in FIG. 9.

In addition to the formation of the lid 74 in front of the pump space of the internal gear pump 40, the third exemplary embodiment differs substantially from the second exemplary embodiment in the configuration of the cavities in the control part. The suction inlet for the two pumps 10 and 40, as in the second exemplary embodiment, is certainly again formed by a radially open spacious recess 60 in the control part 49. However, in the section according to FIG. 7, the recess 60 has pronounced asymmetry, so that, in a region in which one of three machine screws is intended to pass through the control part, there is sufficient material for a bore 77 without interruption. The outer suction groove 33 of the vane pump 10 extends axially between the recess 60 and that end face of the control part 49 which faces the rotor 22, this suction groove 33 having essentially the same appearance as in the second exemplary embodiment and again being located approximately at the outer circumference of the rotor 22. Further inward, namely in the region of the base of the slots 23, the inner suction groove 34 opens into the pump space of the vane pump 10. The recess 60 does not extend radially up to the suction groove 34. There is no fluidic connection between the suction groove 34 and the recess 60, that is the suction inlet of the two pumps. As can be seen in particular from FIG. 8, in which the inner suction groove 34 is depicted by broken lines, the inner suction groove in the third exemplary embodiment does not extend over its entire length in the axial direction beyond the center of the recess 60 into the control part 49. On the contrary, the inner suction groove 34 has a region 78 of smaller depth and a rear region 79, as viewed in the direction of rotation of the rotor, of greater depth. Only this region of greater depth extends in the axial direction beyond the center of the recess 60 into the control part 49 and can be seen in the section according to FIG. 7. Compared with a formation having a greater depth of the inner suction groove over its entire length, the control part 49 of the third exemplary embodiment is more robust.

Figure 10:
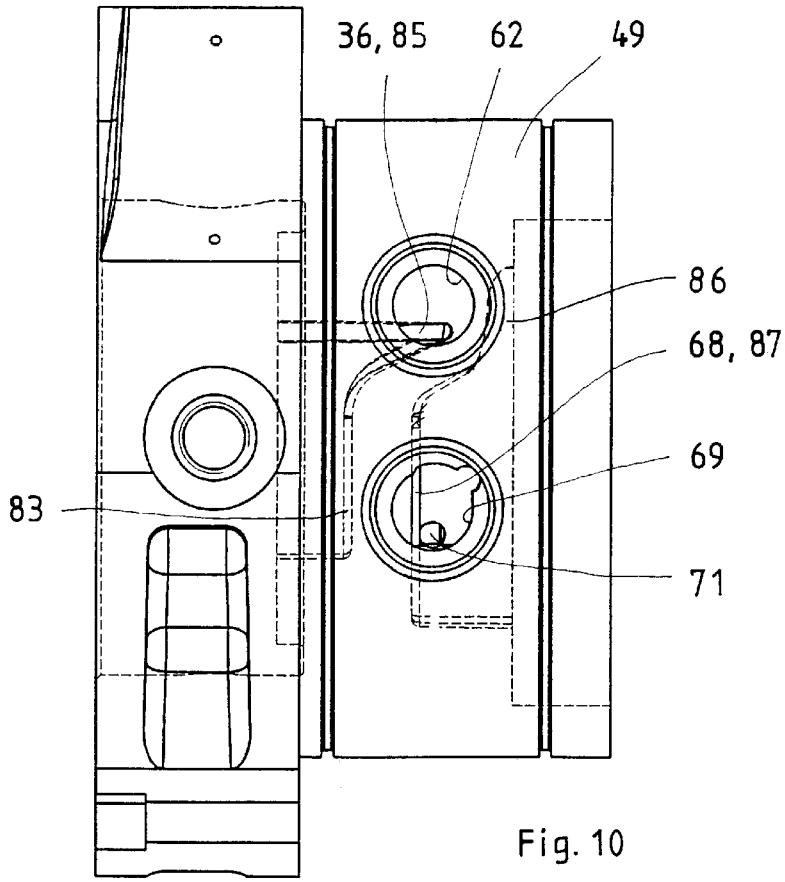
FIG. 10 shows a view of the control part in the direction of the two parallel pressure connections.

Approximately opposite the suction grooves 33 and 34, the inner pressure groove 36 of the vane pump 10, beyond which the rear pressure spaces 28 extend, and the outer pressure groove 35, toward which the pressure spaces 27 open, are incorporated in the control part 49. The two pressure grooves also each have a region 82 and 83, respectively, of small depth and a rear region 84 and 85, respectively, as viewed in the direction of rotation of the rotor, of greater depth, in which they project into the control part 49 well beyond a radial plane which runs in the center of the suction inlet and is identical to the section plane according to FIG. 7. The inner pressure groove 36 with the shallower region 83 and the deeper region 85 is depicted in FIG. 10. Located in the control part 49 in said radial plane is a stepped connection bore 62 which runs tangentially to the axis of the drive shaft 42, corresponds in its.function to the bore of the second exemplary embodiment provided with the same reference numeral, and, on the inside, intersects the two pressure grooves 35 and 36 in their region 84, 85 of greater depth.

As in the second exemplary embodiment, the teeth of the gears 47 and 64 of the internal gear pump 40 in the third exemplary embodiment slide along one another and form pressure spaces between them as the positively driven displacement elements, these pressure spaces, during operation, becoming larger in the suction region and smaller in the pressure region. In the suction region, the pressure spaces are open toward a suction groove 67 which passes through a wall of the control part 49 located between the pump chamber of the internal gear pump 40 and the recess 60. Located approximately opposite the suction groove 67, approximately in the same angular region in which the pressure grooves 35 and 36 of the vane pump 10 also lie, a pressure groove 68 of the internal gear pump 40 is incorporated in the control part. This pressure groove 68 is not located radially outside the pressure groove 35 now but lies at least partly on the same diameter as the pressure grooves 35 and 36. Like the pressure grooves 35 and 36, the pressure groove 68 also has a region 86 of small depth, which is located axially opposite the deeper regions of the pressure grooves 35 and 36, and a region 87 of great depth, which extends axially beyond the above-mentioned radial plane and is located axially opposite the shallower regions of the pressure grooves 35 and 36. A connection bore 69 in the control part 49, which connection bore 69 lies in said radial plane, runs parallel to the connection bore 62 of the vane pump 10 and corresponds in its function to the bore of the second exemplary embodiment provided with the same reference numeral, is open on the inside to the deeper region 87 of the pressure groove 68. In the shallower region 86 of the pressure groove 68, which shallower region 86 is axially opposite the deeper regions of the pressure grooves 35 and 36, there is of course no fluidic connection to the connection bore 62 or to one of the pressure grooves 35, 36. Thus, if the two connection bores 62 and 69 are arranged close together in the same radial plane, the presence of a shallow region and a deep region in the pressure grooves 35, 36 and 68 results in a situation in which, firstly, the correct fluidic connections are produced between the pressure grooves 35, 36 and 68 on the one hand and the connection bores 62 and 69 on the other hand, and, secondly, the pressure groove 68 can lie on the diameter of the pressure grooves 35 and 38, so that little construction space is occupied in the radial direction.

If the pressure groove 68 is located radially outside the pressure groove 35 as in the second exemplary embodiment, only the pressure groove 68 would actually need to have regions of different depth in an arrangement of the connection bores 62 and 69 as in the third exemplary embodiment. The pressure grooves 35 and 36 could extend over their entire length beyond the radial plane considered. However, regions of the pressure grooves 35 and 36 of different depth appear advantageous even in this case, since improved stability of the control part 49 can then be expected.

As in the second exemplary embodiment, a bore 71 starts from the pressure groove 68 in the third exemplary embodiment, and this bore 71, running through the connection bore 69 and parallel to the latter and lying in the radial plane referred to, is incorporated in the control part 49 and thus leads past the shallow regions 82 and 83 of the pressure grooves 35 and 36 of the vane pump and opens into the deeper region 79 at the end of the suction groove 34 of the vane pump 10. As a result, this suction groove 34 of the vane pump 10 is fluidically connected to the pressure groove 68 of the internal gear pump 40. The rear pressure spaces 28 of the vane pump 10 are therefore filled with fluid in the suction region from the pressure outlet of the internal gear pump 40, so that at least approximately the same pressure prevails in them as in the pressure outlet of the internal gear pump 40. Owing to the fact that the connecting bore 71 is made through the connection bore 69, the machining length is shorter. It is not necessary to subsequently close the bore and to cut a thread for a plug to be screwed in.

What is claimed is:

1. A pump assembly comprising a vane pump (10), a suction region in which first pressure spaces (27) between vanes (24) and second rear pressure spaces (28) behind the vanes (24) become larger and a pressure region in which the pressure spaces (27, 28) become smaller and in which the pressure spaces (27, 28) are fluidically connected to a pressure outlet (62, 63), and a second hydraulic pump (40) which is driven together with the vane pump (10) and displacement elements (65, 66) of which are positively driven and supply a circuit having a low system pressure with the pressure fluid via a second pressure outlet (69, 70), wherein the rear pressure spaces (28) of the vane pump (10) are connected in the suction region to the pressure outlet (69, 70) of the second hydraulic pump (40).

2. A pump assembly as claimed in claim 1, wherein the vane pump (10) has a volume which is variably displaceable.

3. The pump assembly as claimed in claim 2, wherein the vane pump includes a stroke ring (25) having an axis and a drive shaft having an axis wherein the vane pump (10) is directly controlled with zero stroke function when the axis of the stroke ring and the axis of the drive shaft are aligned upon reaching a set maximum pressure.

4. The pump assembly as claimed in claim 1, wherein the second hydraulic pump (40) is a pump with two gears (47, 64).

5. The pump assembly as claimed in claim 4, wherein the second hydraulic pump (40) is an internal gear pump without a filling piece.

6. The pump assembly as claimed in claim 1, wherein a construction unit is formed by axially arranging the vane pump (10) and the second hydraulic pump (40) one behind the other.

7. The pump assembly as claimed in claim 6, wherein a control part (49) fixed to a housing is arranged between a rotor (22) of the vane pump (10) and the displacement elements (65, 66) of the second hydraulic pump (40), said control part (49) having a suction inlet (60) common to both hydraulic pumps (10, 40), the vane pump (10) having a first pressure outlet (62) and the second hydraulic pump (40) having a second pressure outlet (69), a radially outer suction groove (33), which opens toward the rotor (22) of the vane pump (10) and is fluidically connected to the suction inlet (60) and with which the first pressure spaces (27) of the vane pump (10) become congruent, and a radially inner suction groove (34), which is open toward the rotor (22) of the vane pump (10) and with which the second pressure spaces (28) of the vane pump (10) become congruent, and also a connecting passage (71) via which the radially inner suction groove (34) is connected to the pressure outlet (69) of the second hydraulic pump (40).

8. The pump assembly as claimed in claim 7, wherein the control part (49) has a pressure groove (68) open toward the gears (47, 64) of the second hydraulic pump (40), and a straight bore extends as the connecting passage (71) between this pressure groove (68) and the inner suction groove (34).

9. The pump assembly as claimed in claim 8, wherein the connecting passage (71) is arranged such that it is directly accessible through the pressure outlet (69) of the second hydraulic pump (40).

10. The pump assembly as claimed in claim 9, wherein the inner suction groove (34) is formed in the shape of an arc of a circle, and the connecting passage (71) opens essentially tangentially into the suction groove (34) at one end of the latter.

11. The pump assembly as claimed in claim 10, wherein the radially inner suction groove (34) of the vane pump (10) has a region (79) of greater axial depth and a region (78) of smaller axial depth, and in that the connecting passage (71) opens into the radially inner suction groove (34) in the region (79) of greater axial depth.

12. The pump assembly as claimed in claim 11, wherein the connecting passage (71) runs essentially in a radial plane disposed perpendicularly to axes of the two pumps (10, 40).

13. The pump assembly as claimed in claim 8, wherein the control part (49) has a pressure groove (68) which opens toward the gears (47, 64) of the second hydraulic pump (40), is located radially outside two pressure grooves (35, 38) of the vane pump (10) and mostly extends over an angular region in which the pressure grooves (35, 36) of the vane pump (10) are also present, and the connecting passage (71) to the radially inner suction groove (34) of the vane pump (10) starts in the vicinity of one end of the pressure groove (68) of the second hydraulic pump (40) and extends past one end of the pressure grooves (35, 36) of the vane pump (10) to the suction groove (34).

14. The pump assembly as claimed in claim 13, wherein the pressure grooves (35, 36) of the vane pump (10) are open at their other ends toward a pressure passage (62) which leads past the pressure passage (68) of the second hydraulic pump (40) to a pressure outlet of the vane pump (10) at the radial outer surface of the control part (49).

15. The pump assembly as claimed in claim 13, wherein the pressure grooves (35, 36) of the vane pump (10) and the pressure groove (68) of the second hydraulic pump (40), as viewed radially, overlap axially.

16. The pump assembly as claimed in claim 7, wherein the control part (49) has a pressure groove (68) which is open toward gears (47, 64) of the second hydraulic pump (40) and mostly extends over an angular region in which the pressure grooves (35, 36) of the vane pump (10) are also present, wherein the pressure grooves (35, 36) of the vane pump (10) have a region (84, 85) of greater axial depth and a region (82, 83) of smaller axial depth, and the pressure grooves (35, 36) and the pressure outlet (62) of the vane pump (10) intersect in that region (84, 85) of the pressure grooves (35, 36) which has a greater axial depth.

17. The pump assembly as claimed in claim 16, wherein the control part (49) has a pressure groove (68) which is open toward the gears (47, 64) of the second hydraulic pump (40) and mostly extends over an angular region in which the pressure grooves (35, 36) of the vane pump (10) are also present, wherein the pressure groove (68) of the second hydraulic pump (40) has a region (87) of greater axial depth and a shallower region (86) having a smaller axial depth, and the pressure groove (68) and the pressure outlet (69) of the second hydraulic pump (40) intersect in that region (87) of the pressure groove (68) which has a greater axial depth.

18. The pump assembly as claimed in claim 17, wherein the deeper region (87) of the pressure groove (68) of the second hydraulic pump (40) is axially opposite the shallower region (82) of at least the radially outer pressure groove (35) of the vane pump (10).

19. The pump assembly as claimed in claim 18, wherein the deeper region of at least the radially outer pressure groove (35) of the vane pump (10) is axially opposite the shallower region (86) of the pressure groove (68) of the second hydraulic pump (40).

20. The pump assembly as claimed in claim 18, wherein the connecting passage (71) runs from the deeper region (87) of the pressure groove (68) of the second hydraulic pump (40) over the shallower regions (82, 83) of the pressure grooves (35, 36) of the vane pump (10) to the radially inner suction groove (34) of the vane pump (10).

* * * * *